US006884087B2

(12) United States Patent
Searls et al.

(10) Patent No.: US 6,884,087 B2
(45) Date of Patent: Apr. 26, 2005

(54) SOCKET WITH MULTIPLE CONTACT PAD AREA SOCKET CONTACTS

(75) Inventors: Damion Searls, Hillsboro, OR (US); Thomas Morgan, Hillsboro, OR (US); Weston Roth, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/671,133

(22) Filed: Sep. 24, 2003

(65) Prior Publication Data

US 2005/0064739 A1 Mar. 24, 2005

(51) Int. Cl.[7] ..... H01R 12/00

(52) U.S. Cl. ..... 439/66; 439/71; 439/620; 439/330; 439/264; 439/525

(58) Field of Search ..... 439/66, 70–71, 439/620, 264, 525, 330

(56) References Cited

U.S. PATENT DOCUMENTS 6,210,176 B1 * 4/2001 Hsiao ..... 439/71
6,561,817 B1 * 5/2003 Ma ..... 439/66

* cited by examiner

*Primary Examiner*—Truc Nguyen
(74) *Attorney, Agent, or Firm*—Schwabe, Williamson & Wyatt, P.C.

(57) ABSTRACT

A socket including multiple contact areas socket contacts is provided. The multiple contact areas enable the placement of components, such as capacitors, resistors, diodes and the like between the socket and a substrate.

15 Claims, 3 Drawing Sheets

SOCKET WITH MULTIPLE CONTACT PAD AREA SOCKET CONTACTS

FIELD OF THE INVENTION

Disclosed embodiments of the invention relate to the field of interfacing load-generating devices to a substrate. More specifically, disclosed embodiments of the invention relate to sockets with multiple contact pad areas socket contacts that can be used for the placement of under-socket components.

BACKGROUND

Higher performance, lower cost, increased miniaturization of integrated circuit components, and greater packaging density of integrated circuits are ongoing goals of the computer industry. As these goals are achieved, microelectronic dice become smaller and power demands become greater. Decreased size, increased number of circuits and greater load demands put a greater demand on state of the art interface between the substrate and the load generating device, such as a microelectronic package.

Commonly, a microelectronic package consists of a microelectronic die coupled to a carrier substrate (collectively referred to as a microelectronic device) may be covered with an encapsulation material, a heat dissipating device or otherwise made into a finished package. A microelectronic package typically interconnects with a system substrate, such as a motherboard, a printed circuit board or an interposer, through a socket connection. A variety of sockets are used in the microprocessor industry, most of which provide a relatively quick and easy interface between the microelectronic package and the substrate.

Current and other signals may be supplied to the microelectronic package through conductive traces in or on the substrate (commonly known as socket paths). Microelectronic devices require a steady state current supply to account for normal operation and current leakage. To perform certain operations, microelectronic devices and other load generating devices require a sudden increase in the current above steady state. This is often referred to as transient current demand.

To accommodate the transient current demands, decoupling capacitors are commonly used. Such capacitors are typically placed around the socket periphery or within socket cutouts in an attempt to get the potential as close as possible to the load. As the distance from the load increases, however, so does the loop inductance and resistance, which in turn decreases the effectiveness of the decoupling capacitors.

Given the increased demands/loads of today's microelectronic devices, one solution has been to place more standard "off-the-shelf" type capacitors near the socket. This is generally considered impractical, however, given the value of the real estate around the socket and the fact that inductance and resistance is still problematic. Nonstandard capacitors designed to have lower inductance and higher capacitance have also been used. Such custom components, however, are very costly and still may not adequately reduce the inductance and resistance to meet the demands of the microelectronic devices.

BRIEF DESCRIPTION OF THE DRAWINGS

The invention is illustrated by way of example and not by way of limitation in the figures of the accompanying drawings, in which the like references indicate similar elements and in which.

DETAILED DESCRIPTION OF EMBODIMENTS OF THE INVENTION

In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Figure 1:
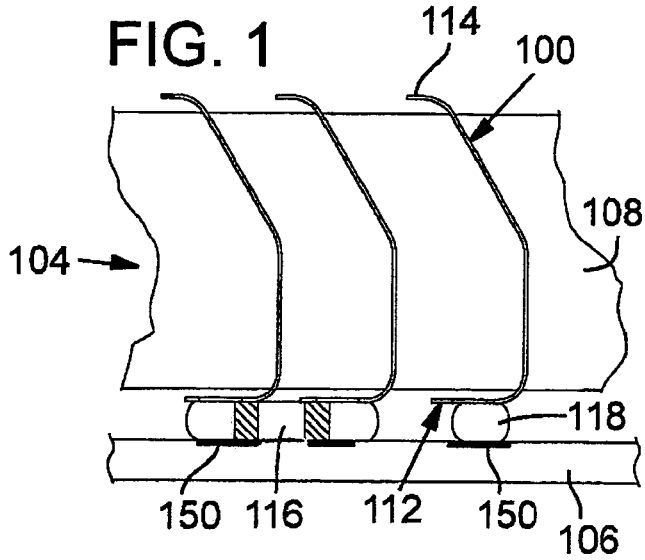
FIG. 1 illustrates a cross-sectional view of a portion of a socket in accordance with an embodiment of the present invention.

FIG. 1 illustrates a cross-sectional view of a portion of a socket in accordance with an embodiment of the present invention. Specifically, socket 104 is coupled to substrate 106. Socket 104 may include a socket body 108, which can be made out of a variety of materials, including, but not limited to, plastics, composite materials, and various dielectric materials. A plurality of socket contacts 100 may be disposed within socket body 108.

Socket contacts 100 have a contact first end 114 and a contact second end 112. First end 114 may be configured to couple a load-generating device, such as a microelectronic package (not shown) to the socket. Second end 112 may have multiple contact areas such that it is configured to couple with land pads 150 positioned on or in substrate 106 and an under socket component. It is understood in the art that the terms "land pads" and "bond pads" are terms for referring to pads, plated through holes, or any other structure that allows for electrical communication between the carrier substrate circuitry and an attached component. Interconnect 118 may secure the contact second end 112 to the land pad. Interconnect 118 may include, but is not limited to lead-free solder, leaded solder, conductive adhesive, or other conductive materials that may electrically and, if necessary, mechanically couple the contact to the land pad.

A standard component form factor, which may include components such as capacitors, diodes, resistors, inductors and the like, can be placed between the socket and the substrate in order to get the component closer to the load to reduce the resistance and loop inductance normally encountered. As illustrated in FIG. 1, a standard-sized capacitor 116 may be disposed between adjacent land pads 150. Capacitor 116 may also have its electrodes in electrical communication with a contact pad area of the second end 112 that is not in electrically coupled to the land pad 150 of substrate 106. Placement of capacitor 116 directly in electrical communication with contact 100 may lower the resistance characteristics, and/or shorten the transmission distance to the load of the microelectronic package. This tends to reduce the inductance and resistance encountered, thereby allowing the capacitor to discharge its current quickly and effectively meet the immediate load demand imposed by the microelectronic package.

Figure 2:
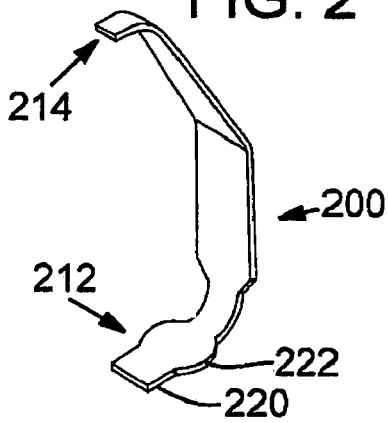
FIG. 2 illustrates an enlarged perspective view of a socket contact in accordance with an embodiment of the present invention.

FIG. 2 illustrates an enlarged perspective view of a socket contact in accordance with an embodiment of the present invention. First end 214 is formed of a simple geometry, which may include a square, rectangular or circular-shaped end. As shown, first end 214 is of a square configuration where the end of contact 200 is bent over to enable contact with a microelectronic package (not shown). In some embodiments, the second end 212 may have a complex geometry, which may facilitate coupling of the second end to the land pad of a substrate as well as another form factor component.

The complex geometry of second end 212 may include any non-simple geometry shape that extends to allow electrical interconnection of the second end 212 with land pads and other components. Several examples of complex geometries, are shown in the illustrated embodiments in accordance with the present invention. In general, the complex geometry could be any non-simple geometry, which may include a combination of multiple simple geometries, such as a circular portion and a rectilinear portion extending therefrom. The complex geometries may extend both in two dimensions or in three dimensions as shown by way of example in FIGS. 7–9.

First end 212 of contact 200 is of a simple geometry and configured to couple to, for example, the land pads of a carrier substrate. Second end 212 is of a complex geometry that has a first contact pad area 222 and a second contact pad area 220 extending from the end of the first contact pad area. This complex geometry results in second end 212 being elongated. Depending on the positioning of contact 200 within the socket body 208 and the complex geometry of second end 212, the first contact pad area 222 may electrically couple to a land pad. The second contact pad area then may be electrically coupled to a electrode of the capacitor, for example. Likewise, first contact pad area 222 may be electrically coupled to a component while second contact pad area 220 may be electrically coupled to a land pad. The coupling to the land pad may be through an interconnect, such as a solder ball. The coupling to the component may also be through an interconnect, or the component may be in direct contact with the elongated second end.

Figure 3:
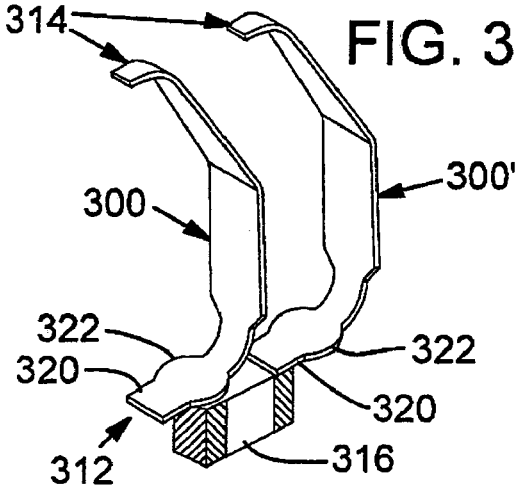
FIG. 3 illustrates a perspective view of a plurality of socket contacts and a component placed underneath and in between the socket contacts, in accordance with an embodiment of the present invention.

FIG. 3 illustrates a perspective view of a plurality of socket contacts and a component placed underneath, in accordance with an embodiment of the present invention. Two socket contacts 300 and 300' are electrically coupled to a capacitor 316. Second contact pad area 322 of the second end 312 having a complex geometry may be electrically coupled to capacitor 316. First contact pad area 320 of contact 300' having a complex geometry is electrically coupled to capacitor 316. In this configuration, the contacts 300 and 300', and capacitor 316 may be placed on a substrate and electrically coupled to land pads, as shown in FIG. 1, for example. The complex geometry of the contacts 300 and 300' thereby enabling one portion of the second end 300 or 300' to electrically couple to the substrate.

This embodiment illustrates how standard components may be pre-positioned on the socket contacts prior to coupling the socket to the substrate. As shown, capacitor 316 is coupled to contacts 300 and 300'. However, in alternate embodiments, a variety of the under-socket components can be used with the elongated contact second end 312.

Figure 4:
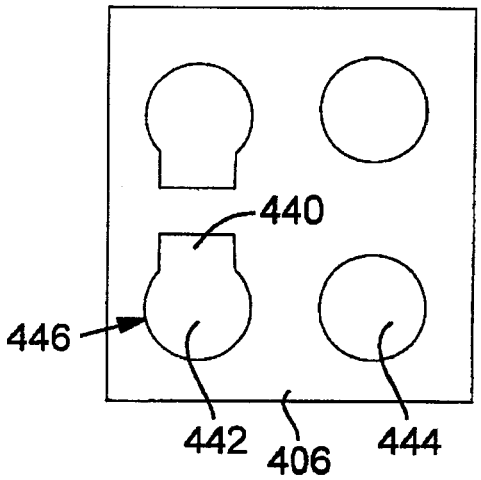
FIG. 4 illustrates a top view of a plurality of substrate land pads in accordance with an embodiment of the present invention.

FIG. 4 illustrates a top view of substrate land pads in accordance with an embodiment of the present invention. Substrate 406 has a plurality of land pads 446 and 444. Land pads 444 may be configured, for example, for signal transmission, while land pads 446 may be power and ground leads. Land pads 446 may also be of a complex geometry, elongated such that they have a component area 440 configured to enable electrical coupling of a component with the substrate 406, and a contact area 442 configured to electrically couple to a socket contact. Similar to FIG. 3, but not shown, a component may be pre-positioned on the substrate, such that complex geometry of the land pad enables the contact areas of the component to couple to the component areas 440 of adjacent land pads 446, while contact areas 442 are configured to enable electrical coupling with socket contact second ends of a corresponding complex geometry (not shown).

Figure 5:
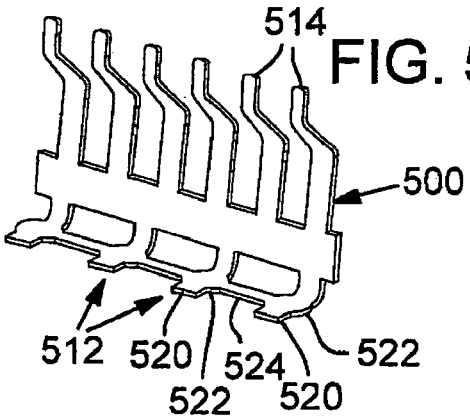
FIG. 5 illustrates a perspective view of a plurality of interconnected socket contacts, in accordance with an embodiment of the present invention.

FIG. 5 illustrates a perspective view of a socket contact arrangement in accordance with an embodiment of the present invention. The arrangement includes a plurality of electrically interconnected socket contacts 500. The arrangement is sometimes referred to as a comb. Each socket contact has a first end 514 of a simple geometry and an elongated second end 512 having a complex geometry. Each elongated second end 512 includes a contact first pad area 522 and a second contact pad area 520. Depending on the position of the contacts, the contact first pad area 522 may either be electrically coupled with a component, such as a capacitor, or with a land pad through an interconnect. It is also possible to use a multi-pack component, which can have a plurality of leads/contacts, and connect such multiple contacts to the plurality of elongated second ends.

Figure 6:
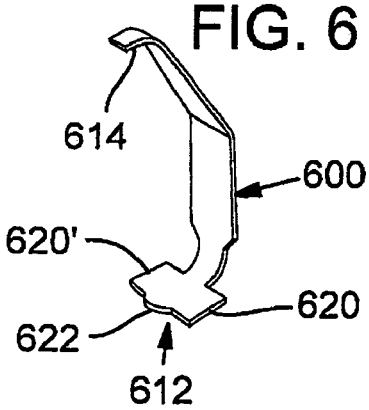
FIG. 6 illustrates a perspective view of a socket contact in accordance with an embodiment of the present invention.

FIG. 6 illustrates a perspective view of a socket contact in accordance with an embodiment of the present invention. The elongated second end 612 of socket contact 600 is of a complex geometry that has a plurality of second contact pad areas 620, 620' that extend from the first contact pad area 622. Second contact pad areas 620, 620' may allow a single contact 600 be coupled to multiple components. They may also provide versatility for contact 600. Depending on where the component needs to be positioned, either second contact pad area 620 or 620' may be coupled to the component. Or, each second contact pad area 620 and 620' may be coupled to a component.

Figure 7:
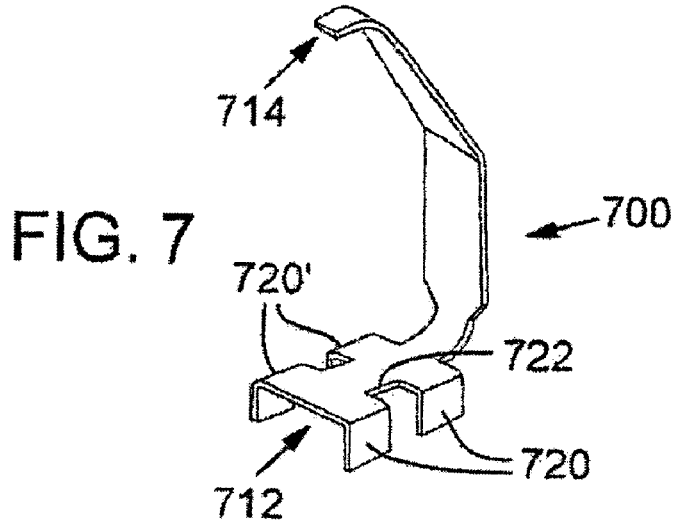
FIG. 7 illustrates a perspective view of a socket contact in accordance with an embodiment of the present invention.

FIG. 7 illustrates a perspective view of a socket contact in accordance with an embodiment of the present invention. The second end 712 of contact 700 is of a complex geometry that has second contact pad areas that extend in a third dimension. First contact pad area 722 is adapted to electrically couple to a land pad, for example. Second end 712 also may have at least one opposing pair of second contact pad areas 720 and 720', extending downwardly from the first contact pad area 722, and that may be opposably spaced apart such that they encompass a portion of a component.

Figure 8:
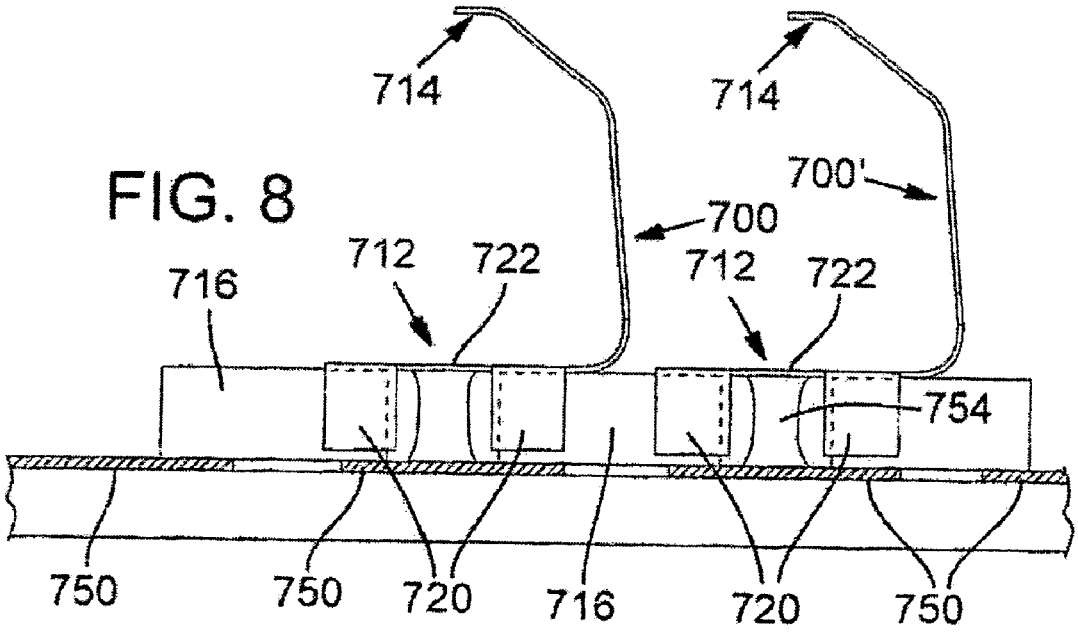
FIG. 8 illustrates an enlarged side view of a portion of a socket having a plurality of socket contacts of FIG. 7 in accordance with an embodiment of the present invention.

FIG. 8 illustrates an enlarged side view of a portion of a socket including the socket contact of FIG. 7 in accordance with an embodiment of the present invention. The complex geometry second ends 712 and 712' of contacts 700 and 700' each have a one or more opposing pair of second contact pad areas 720 (shown) and 720' (not shown). Where there are more than one opposing pair of second contact pad areas, as shown in both FIGS. 7 and 8, multiple components may be electrically coupled to a single contact 700.

The complex geometry extending into the third dimension enables capacitors 716 to be placed between each opposing pair of second contact pad areas 720 and 720' on one contact 700 and an opposing pair of second contact pad areas 720 and 720' of an adjacent contact 700'. The second ends 712 of each contact 700 may be coupled to a substrate through interconnect 754 by coupling the first contact pad area 722 to a complementary portion of a land pad 750. Capacitor 716 may be coupled to land pad 750 by an interconnect or can be placed directly in contact therewith.

Referring back to FIG. 7, a component may be coupled to contact 700 in a variety of ways. For example, opposing pair of second contact pad areas 720 and 720' may be sized such that they pinch the component, thereby electrically and mechanically coupling the contact to the component. Interconnect may also be used to couple the component between the opposing pair of second pad areas 720 and 720'.

Figure 9:
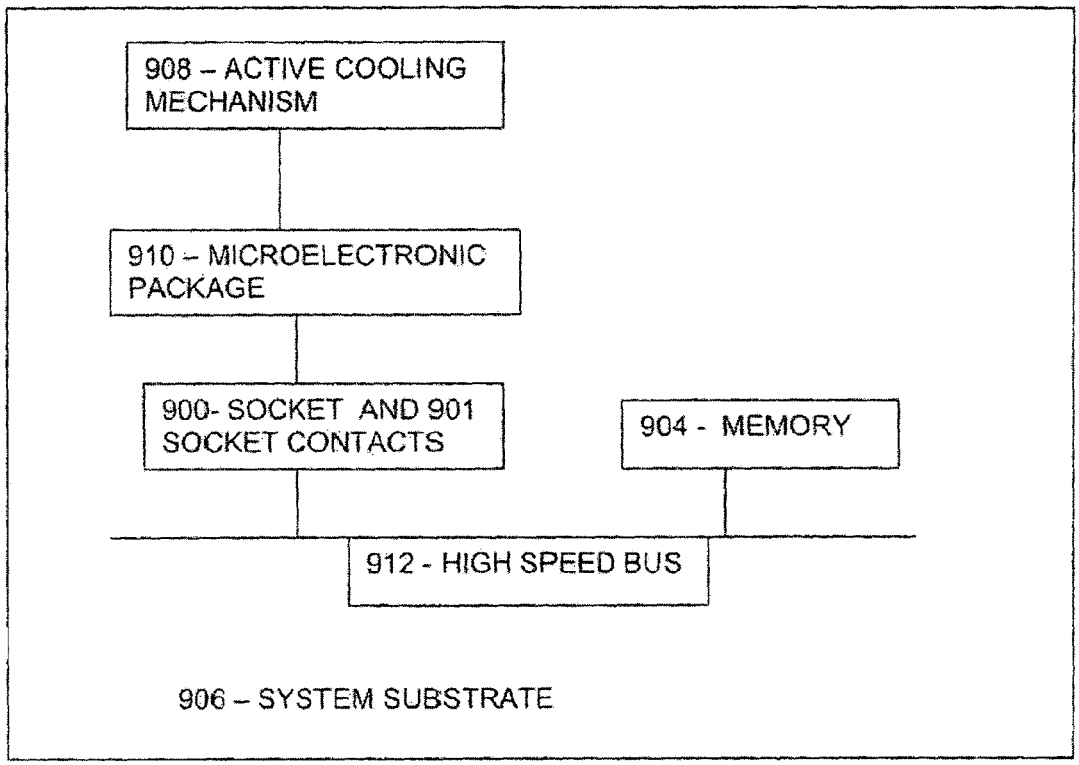
FIG. 9 is an example system suitable for practicing the present invention in accordance with one embodiment.

FIG. 9 is an example system suitable for practicing one embodiment of the present invention. A socket 900 having socket contacts 901 in accordance with the present invention is coupled to system substrate 906 and high-speed bus 912. System substrate 906 may be a carrier substrate, such as a motherboard or other printed circuit boards. Microelectronic package 910 may be coupled to socket 900. As shown, attached to the system substrate 906 also includes a memory 904 configured to store data. Memory 904 is coupled to the system substrate 906 through high-speed bus 912. Memory 904 may include but is not limited to dynamic random access memory (DRAM), synchronous DRAM (SDRAM), and the like. In the embodiment shown, an active cooling mechanism 908 is thermally coupled to the microelectronic package 910 to help keep the microelectronic package 910 from overheating. Active cooling mechanism may include, but is not limited to fans, blowers, liquid cooling loops and the like.

Though a decoupling capacitor has been used as an example component in the above illustrations and descriptions of embodiments in accordance with the present invention, in alternate embodiments, a variety of other components may be used with contacts having second ends with complex geometry in accordance with the present invention. For example, a resistor may be placed between contacts in order to dampen a signal. Or, one may choose to place one or more light emitting diodes under socket for electro-optical conversion points. Likewise, simple diodes can be placed under the socket using the present invention. Virtually any component may be placed under-socket using the present invention in order to get the component closer to the load.

It can also be appreciated that despite the illustrated embodiments showing the complex geometry of the second contact pad areas to be somewhat rectilinear protrusions from a curvilinear contact, a variety of shapes (complex or simple) may be combined, provided the resulting complex geometry of the second contact pad areas can enable coupling of (e.g. standard-sized) components to the contact (while coupling to a substrate). Further, the complex geometry second end of the contact in accordance with the present invention may be used with a variety of socket-to-substrate interface configurations, including, but not limited to, land grid arrays (LGA)(shown in the illustrated embodiments), pin grid arrays (PGA), ball grid arrays (BGA) and other interface configurations.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A socket contact, comprising:

a first end configured to interconnect with a load-generating device; and a second end, the second end having a contact pad configured to enable placement of an electronic component between the socket contact and a substrate and electrical coupling of the electronic component between the socket contact and a bus disposed on the substrate;

wherein the contact pad includes a first contact pad area that is curvilinear and a second contact pad area that is rectilinear.

2. The socket of claim 1, wherein the first contact pad area is configured to couple to an interface configuration selected from a group including LGA, PGA, CSP, and BGA.

3. The socket of claim 1, wherein the second contact pad area extends in a third dimension from the first contact pad area.

4. The socket of claim 3, wherein the second contact pad area includes a pair of opposed contact pad areas configured to grippingly engage a component.

5. The socket of claim 1, wherein the electronic component is selected from a group including capacitors, resistors, diodes, and inductors.

6. The socket contact of claim 1, wherein a plurality of socket contacts are electrically and mechanically interconnected with each other.

7. A system, comprising:

a system substrate;

a bus disposed on the system substrate to facilitate data exchange;

a socket coupled to the system substrate, the socket including:

a body;

a socket contact housed by the body, the socket contact including a first end configured to interconnect with a load generating device; and a second end, the second end having a contact pad configured to enable placement of an electronic component between the socket contact and a substrate and electrical coupling of the electronic component between the socket contact and the bus;

wherein the contact pad includes a first contact pad area that is curvilinear and a second contact pad area that is rectilinear.

8. The system of claim 7 wherein the first contact pad area is configured to couple to an interface configuration is selected from a group including LGA, PGA, CSP, and BGA.

9. The system of claim 7, wherein the second contact pad area extends in a third dimension from the first contact pad area.

10. The system of claim 9, wherein the second contact pad area includes a pair of opposed contact pad areas configured to grippingly engage a component.

11. The system of claim 7, wherein the electronic component is selected from a group including capacitors, resistors, diodes, and inductors.

12. The system of claim 7, wherein a plurality of socket contacts are electrically and mechanically interconnected with each other.

13. A socket connection, comprising:

a substrate;

an electronic component, the electronic component electrically coupled to the substrate; and a socket body, the socket body including a plurality of socket contacts, each of the socket contacts including a first end configured to electrically couple with a load generating device, and a second end, the second end having a contact pad configured to enable placement of the electronic component between the contact second end and the substrate and electrical coupling of the electronic component between the socket contact and a bus disposed on the substrate.

14. The socket connection of claim 13, wherein the first end is of a simple geometry and the second end is of a complex geometry.

15. The socket connection of claim 13, wherein the electronic component is selected from a group including capacitors, resistors, diodes, and inductors.

* * * * *